US007928956B2

(12) United States Patent
Chao et al.

(10) Patent No.: US 7,928,956 B2
(45) **Date of Patent: *Apr. 19, 2011**

(54) DIGITAL CONTROLLED MULTI-LIGHT DRIVING APPARATUS AND DRIVING-CONTROL METHOD FOR DRIVING AND CONTROLLING LIGHTS

(75) Inventors: Yuan-Jen Chao, Kaohsiung (TW); Feng-Li Lin, Taishan Township (TW)

(73) Assignee: Gigno Technology Co., Ltd., Taipei (TW)

( * ) Notice: Subject to any disclaimer, the term of this patent is extended or adjusted under 35 U.S.C. 154(b) by 881 days.

This patent is subject to a terminal disclaimer.

(21) Appl. No.: 11/896,250

(22) Filed: Aug. 30, 2007

(65) Prior Publication Data

US 2007/0296716 A1 Dec. 27, 2007

Related U.S. Application Data

(63) Continuation-in-part of application No. 10/715,414, filed on Nov. 19, 2003, now Pat. No. 7,388,570.

(30) Foreign Application Priority Data

| | | |
|---|---|---|
| Nov. 20, 2002 | (TW) | 91218715 U |
| Dec. 26, 2002 | (CN) | 02 2 92605 |
| Nov. 19, 2003 | (JP) | 2003-272603 |
| Aug. 31, 2006 | (TW) | 95132244 A |
| Aug. 20, 2007 | (TW) | 96130724 A |

(51) Int. Cl.
*G09G 3/36* (2006.01)

(52) U.S. Cl. ..... 345/102; 345/82; 345/204

(58) Field of Classification Search ..... 345/82, 345/102, 204; 362/97.1, 97.2
See application file for complete search history.

(56) References Cited

U.S. PATENT DOCUMENTS

| | | | |
|---|---|---|---|
| 4,529,914 | A | 7/1985 | Kaneda et al. |
| 5,272,327 | A | 12/1993 | Mitchell et al. |
| 5,461,397 | A | 10/1995 | Zhang et al. |
| 5,818,172 | A | 10/1998 | Lee et al. |
| 5,854,617 | A | 12/1998 | Lee et al. |
| 5,892,336 | A | 4/1999 | Lin et al. |
| 6,060,843 | A | 5/2000 | Primisser et al. |
| 6,069,449 | A | 5/2000 | Murakami et al. |
| 6,075,325 | A | 6/2000 | Kouno et al. |
| 6,104,146 | A | 8/2000 | Chou et al. |
| 6,201,352 | B1 | 3/2001 | Ge et al. |
| 6,243,067 | B1 | 6/2001 | Noguchi et al. |
| 6,243,068 | B1 | 6/2001 | Evanicky et al. |
| 6,420,839 | B1 | 7/2002 | Chiang et al. |
| 6,448,955 | B1 | 9/2002 | Evanicky et al. |
| 6,496,236 | B1 | 12/2002 | Cole et al. |

(Continued)

*Primary Examiner* — Amare Mengistu
*Assistant Examiner* — Premal Patel
(74) *Attorney, Agent, or Firm* — Birch, Stewart, Kolasch & Birch, LLP

(57) ABSTRACT

A digital controlled multi-light driving apparatus for driving and controlling a plurality of lights. The digital controlled multi-light driving apparatus includes a plurality of oscillation step-up circuits and a digital control circuit. The digital control circuit has a counter unit, a memory unit, a comparator unit, and a driving unit. The counter unit starts counting to generate a counting value whenever a digital start signal is generated. The memory unit stores at least one target counting value. The comparator unit is electrically connected to the counter unit and the memory unit to generate triggering signals whenever the counting value matches the target counting value. The driving unit is electrically connected to the comparator unit to output sequentially delayed driving signals to the oscillation step-up circuits respectively on receiving the triggering signals.

20 Claims, 20 Drawing Sheets

U.S. PATENT DOCUMENTS 6,856,519 B2 2/2005 Lin et al.
6,947,024 B2 9/2005 Lee et al.
6,961,044 B2 11/2005 Woo
2002/0140538 A1 10/2002 Yer et al.
2003/0122771 A1 7/2003 Sumiyoshi et al.
2007/0257869 A1* 11/2007 Huang et al. ..... 345/82

* cited by examiner

DIGITAL CONTROLLED MULTI-LIGHT DRIVING APPARATUS AND DRIVING-CONTROL METHOD FOR DRIVING AND CONTROLLING LIGHTS

CROSS REFERENCE TO RELATED APPLICATIONS

This Non-provisional application is a continuation-in-part of U.S. application Ser. No. 10/715,414, filed on Nov. 19, 2003, which claims the priority under 35 U.S.C. §119(a) on Patent Application No(s). 09218715 filed in Taiwan, Republic of China on Nov. 20, 2002. This Non-provisional application also claims priority under 35 U.S.C. §119(a) on Patent Application No(s). 095132244 filed in Taiwan, Republic of China on Aug. 31, 2006 and Patent Application No(s). 096130724 filed in Taiwan, Republic of China on Aug. 20, 2007.

BACKGROUND OF THE INVENTION

1. Field of Invention

The invention relates to a light driving apparatus and a driving-control method of lights, and, in particular, to a digital controlled multi-light driving apparatus for a large size flat panel display and a driving-control method of lights having a sequential flashing function.

2. Related Art

Flat panel displays have become increasingly popular in recent years, with liquid crystal displays (LCDs) garnering the most widespread acceptance. Conventional LCDs are typically employed as personal computer monitors and have a screen size of 15" or less. As manufacturing technology has developed, a variety of display sizes have come to be employed for different purposes, including use as TV displays. When employed for this purpose, a flat panel LCD with a screen size of 30" or larger is desirable. Accordingly, an LCD of this size requires a greater number of lights to provide adequate brightness. For example, an LCD with a screen size of 40" may require up to 30 lights.

When the number of lights is increased, however, an accompanying problem of poor brightness uniformity between lights arises. In addition, the number of light driving apparatuses for driving the lights is also increased. For example, regarding the conventional light driving apparatus, usually only two cold cathode fluorescent lamps (CCFLs) can be driven at the same time by one transformer. Thus, for an LCD with a large screen size requiring increased number of lights, the number of required light driving apparatuses is also increased, and manufacturing costs thereof increase as a result.

As previously mentioned, the conventional LCD typically employs CCFLs as backlights thereof. To induce the CCFL or CCFLs to light, a light driving apparatus with an inverter is typically used. Referring to FIG. 1, a conventional light driving apparatus 1 mainly includes a current adjusting circuit 11, an oscillation step-up circuit 12, a detecting circuit 13, and a feedback control circuit 14.

The current adjusting circuit 11 is controlled by the feedback control circuit 14 and properly adjusts an external DC source, which is then input to the oscillation step-up circuit 12. The oscillation step-up circuit 12 converts the input DC source into an AC signal and amplifies the AC signal. The amplified AC signal is then provided to the CCFL 2, which serves as the light, so that the CCFL 2 can then light. Furthermore, the detecting circuit 13 detects a feedback signal, such as a current signal or a voltage signal, from one end of the CCFL 2. The feedback signal is then transmitted to the feedback control circuit 14. The feedback control circuit 14 controls the current adjusting circuit 11 according to the feedback signal, so that the current adjusting circuit 11 can output a suitable current level. It should be noted that the conventional feedback control circuit 14 is an analog feedback control circuit.

When the number of lights is increased, the number of required light driving apparatuses 1 is increased accordingly. In an LCD with a large screen size, a plurality of circuits, each of which includes the current adjusting circuit 11, oscillation step-up circuit 12, detecting circuit 13 and feedback control circuit 14, are necessary at the same time. Since the lights are driven by different driving apparatuses 1, which are independent from one another, the brightness uniformity adjustment or phase matching between lights cannot be efficiently achieved, resulting in poor display quality.

Therefore, it is an important subjective to prevent the above-mentioned problems, so as to improve the quality of an LCD with a large screen size and reduce manufacturing costs.

Nowadays, liquid crystal displays (LCD) are being used widely. They can be found on computer monitors, touch-screens for man-machine interface and home televisions. As popularity grows, its technical performance becomes more demanding in parameters such as viewing angle, contrast ratio, color saturation, and response time.

Among all the performance parameters, quick response time has always been one of the most sought-after items in improving motion picture quality. Low quality LCD with slow response time often causes picture blurring while viewing moving objects. This may not be a major issue if the LCD is just for a desktop computer monitor on which most of the pictures are still all the time. However, if the LCD is for home televisions, quicker response time is a must.

Besides the response time, there is a fundamental technical issue, the display type (or mode), that limits the LCD motion picture quality. The CRT display device, the predecessor of LCD, displays pictures by tracing out the images on a glass screen with a single scanning electron beam. Therefore, at any given moment, only a small fraction of the glass screen will be lightened while being scanned across by the electron beam. CRT display device cannot hold still the complete picture to be displayed on the glass screen. Actually, it displays pictures dot-by-dot and line-by-line. This is referred to as impulse-type display. LCD displays pictures in a different way. The LCD screen is composed of numerous pixels arrayed in rows and columns. Each pixel stores a graphic data. To display a picture, the LCD screen loads pixel data of a complete frame in parallel. Each pixel keeps its graphic data until being reloaded. At any given time, every pixel of the entire screen is lightened. Hence, LCD can hold still the complete picture to be displayed, so it displays pictures frame-by-frame. This is referred to as holding-type display.

A major drawback of holding-type display is the picture blurring caused by frame switching when displaying moving objects. Because the previous frame will never completely disappear from the screen before the next frame comes in. The most straightforward way to solve this problem is to make the previous frame disappear completely by inserting an extra dark frame before the next frame comes in. This will require some efforts on graphic processor. Another simpler solution is to shut off the backlight module of the LCD device for a specific period of time to create a momentary dark image. This dark image neutralizes human eyes from the previous frame and makes them ready to accept the next one. This is referred to as flashing backlight technology. To further eliminate blurring of holding-type display and mimic impulse-type display, an LCD backlight module is divided into several light zones. Each zone can be turned on and off sequentially. A specific control timing sequence is used to turn on and off each light zone. This timing sequence is synchronized to the frame data reload timing to optimize the motion picture quality. This is referred to as sequential flashing backlight technology. Since this sequential flashing backlight technique turns on and off a number of individual light zones, this can also be applied to power-saving and brightness-dimming control.

In some related arts, analog phase delay array is adopted to do the backlight on/off control. However, the timing sequence is adjusted by altering resistance or capacitance value of the control circuit. Therefore, it is an important subject to provide a digital programmable control for making the timing adjusting easier.

SUMMARY OF THE INVENTION

In view of the foregoing, the invention is to provide a digital programmable control for making the timing adjusting easier.

To achieve the above, this invention discloses a digital controlled multi-light driving apparatus for driving and controlling a plurality of lights. The digital controlled multi-light driving apparatus includes a plurality of oscillation step-up circuits and a digital control circuit. The digital control circuit has a counter unit, a memory unit, a comparator unit, and a driving unit. The counter unit starts counting to generate a counting value whenever a digital start signal is generated. The memory unit stores at least one target counting value. The comparator unit is electrically connected to the counter unit and the memory unit to generate triggering signals whenever the counting value matches the target counting value. The driving unit is electrically connected to the comparator unit to output sequentially delayed driving signals to the oscillation step-up circuits respectively on receiving the triggering signals.

To achieve the above, this invention also discloses a driving-control method for driving and controlling a plurality of lights that includes the following steps of: generating a digital start signal, activating a counter unit to count so as to generate a counting value on receiving the digital start signal, comparing the counter value with at least one target counting value to generate at least one triggering signal, and outputting sequentially delayed driving signals on receiving the triggering signal.

As mentioned above, the digital controlled multi-light driving apparatus and the driving-control method of the invention have the following advantages. The comparator unit is utilized to compare the counting values generated by the counter unit with the target counting value stored in the memory unit to generate the sequentially delayed driving signals. Thus, when the oscillation step-up circuits of the backlight module are driven by the sequentially delayed driving signals, the light driven by the oscillation step-up circuits can be sequentially lighted so that the lights alternately light on and off. In other words, the impulse-type display may be simulated using the simple digital circuit design in accordance with the driving-control device and the method of the backlight module of the invention, and the blurring phenomenon may be reduced.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
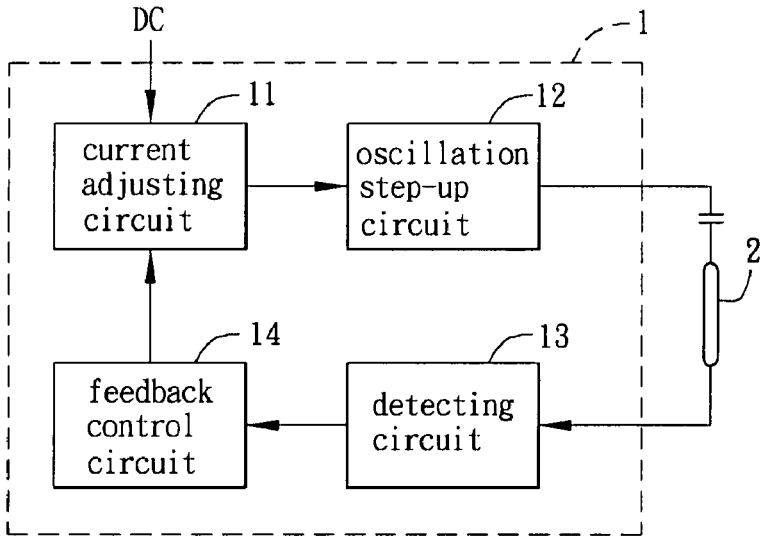
FIG. 1 (Prior Art)
FIG. 1 is a block diagram showing a conventional light driving apparatus.
Figure 2:
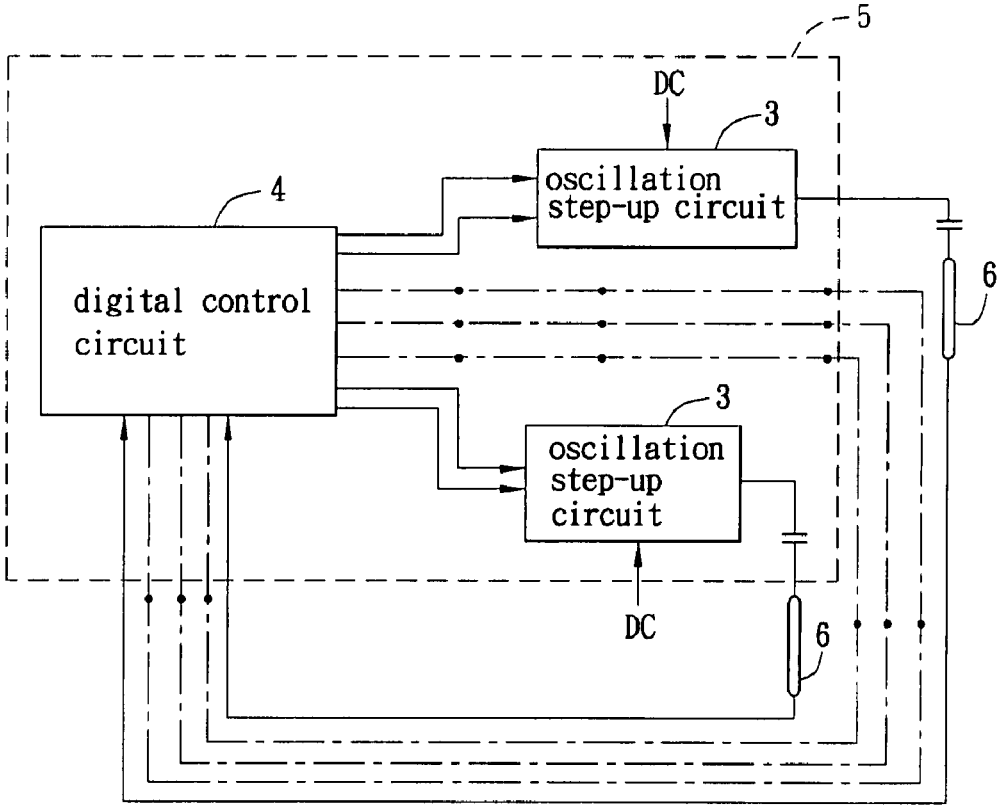
FIG. 2 is a block diagram showing a digital controlled multi-light driving apparatus according to a preferred embodiment of the invention.

Referring to FIG. 2, a digital controlled multi-light driving apparatus 5 includes a plurality of oscillation step-up circuits 3 and a digital control circuit 4.

Figure 3:
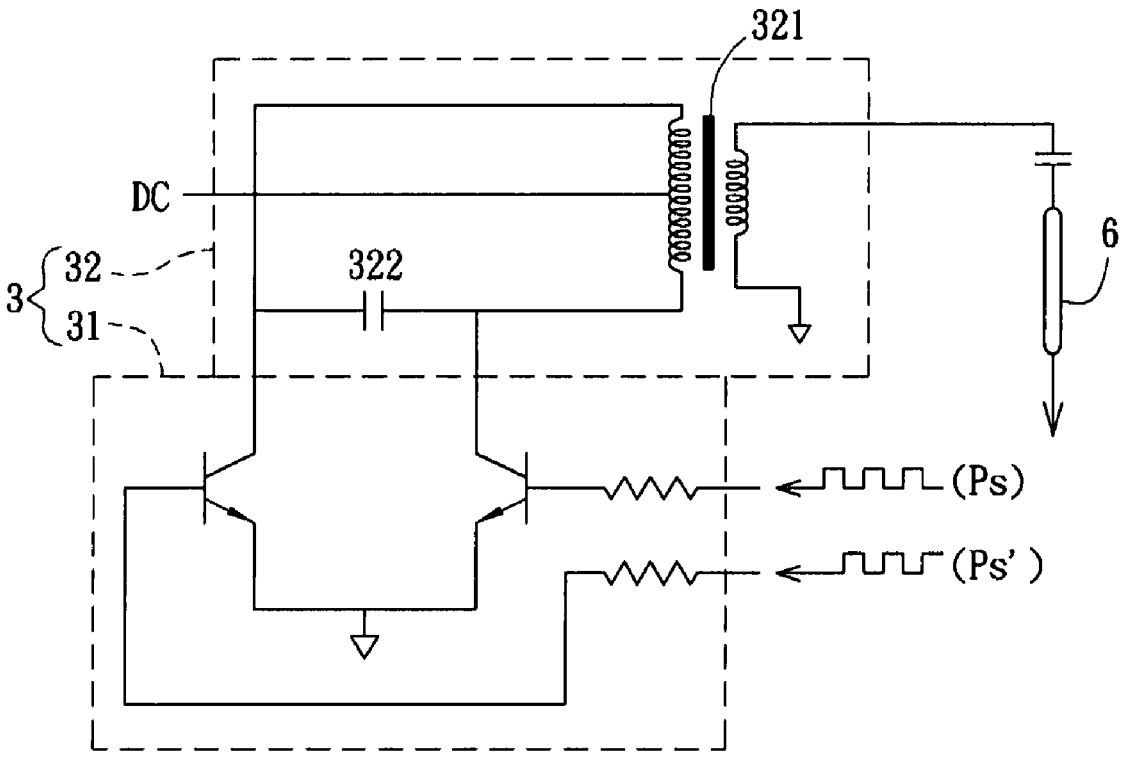
FIG. 3 is a schematic illustration showing an oscillation step-up circuit of the digital controlled multi-light driving apparatus of the invention.

The digital control circuit 4 electrically connects to the oscillation step-up circuits 3, respectively. The digital control circuit 4 generates sets of delayed driving signals PSn and PSn' (as shown in FIG. 3), which are and phase controllable and duty cycle controllable, and respectively transmits the sets of the delayed driving signals PSn and PSn' to the oscillation step-up circuits 3. The phase and duty cycle of each set of delayed driving signals PSn and PSn' are controlled by the digital control circuit 4. The delayed driving signals PSn and PSn' are digital signals. The oscillation step-up circuits 3 drive the light loads 6 to emit light. Each of the light loads 6 may be a cold cathode fluorescent lamp (CCFL), a hot cathode fluorescent lamp (HCFL) or a light emitting diode (LED).

With reference to FIG. 3, each oscillation step-up circuit 3 includes a switching unit 31 and a resonance step-up unit 32. In the present embodiment, the switching unit 31 includes two bipolar transistors and two resistors. One end of each resistor connects to the base electrode of each corresponding bipolar transistor, and the other end of each resistor connects to the digital control circuit 4 for receiving the delayed driving signals PSn and PSn'. The resonance step-up unit 32 mainly consists of a transformer 321 and a capacitor 322. The two ends of the capacitor 322 electrically connect to the collectors of the bipolar transistors, respectively. Moreover, the resonance step-up unit 32 may at least electrically connect to one cold cathode fluorescent lamp (CCFL) 2, which serves as the light. It should be noted that the switching unit 31 may also consist of two MOS transistors (not shown). In this case, the delayed driving signals PSn and PSn' input from the digital control circuit 4 are used to control the gates of the MOS transistors.

In summary, since the digital controlled multi-light driving apparatus 5 of the invention only employs one digital control circuit 4 to control a plurality of oscillation step-up circuits 3, the conventional current adjusting circuit 11 is unnecessary and omitted. Furthermore, the conventional feedback control circuit 14 is not repeatedly used. In other words, the digital controlled multi-light driving apparatus 1 of the invention has a simple structure, and therefore is less costly to manufacture. Moreover, the digital controlled multi-light driving apparatus 1 has a digital control circuit 4 for generating sets of digital switching signals, which are phase controllable and duty cycle controllable. The oscillation step-up circuits 3 can be controlled according to the sets of digital switching signals, so that the phases and brightness of different lights can be respectively controlled to improve the display quality of an LCD.

Figure 4:
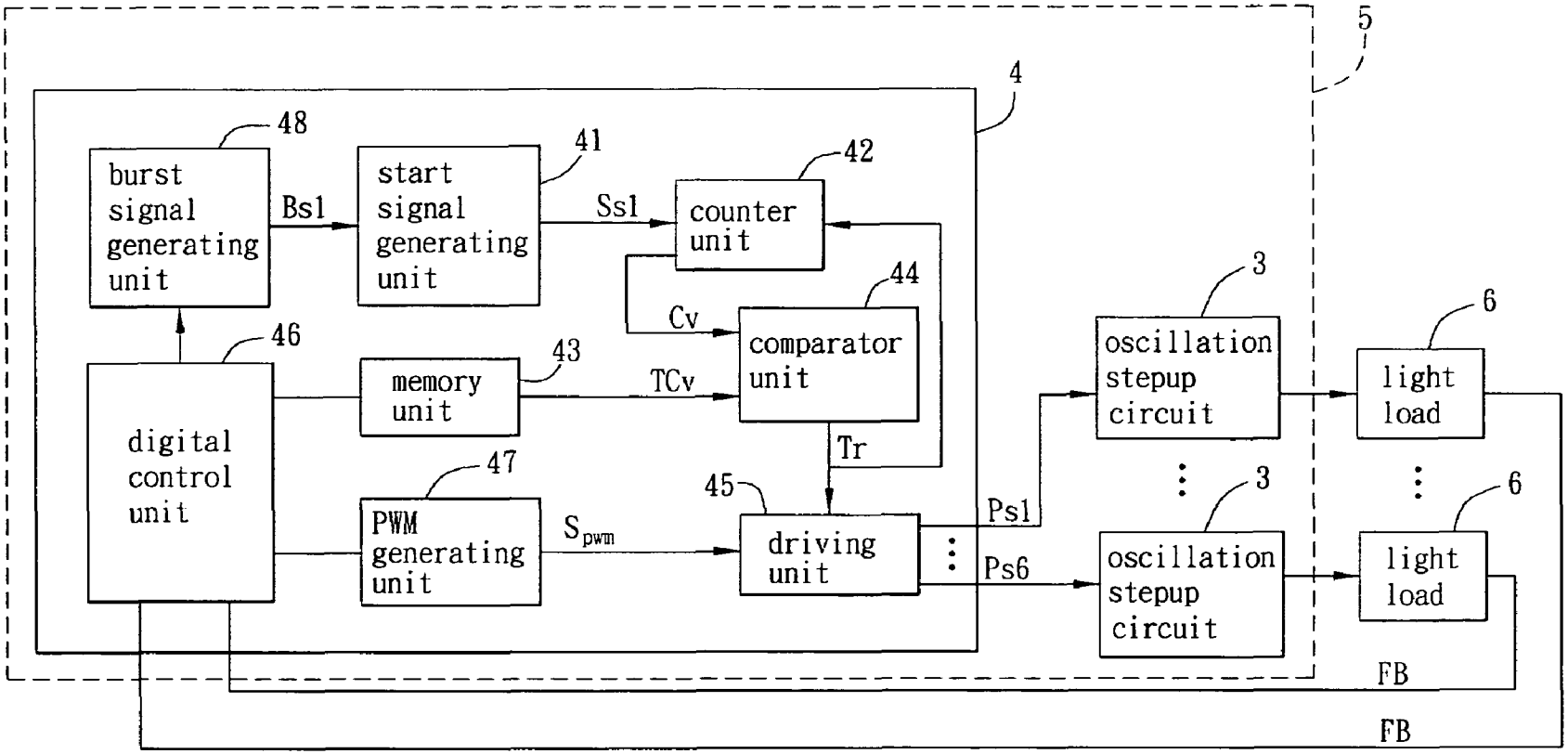
FIG. 4 is a block diagram showing a digital controlled multi-light driving apparatus according to the preferred embodiment of this invention.
Figure 5:
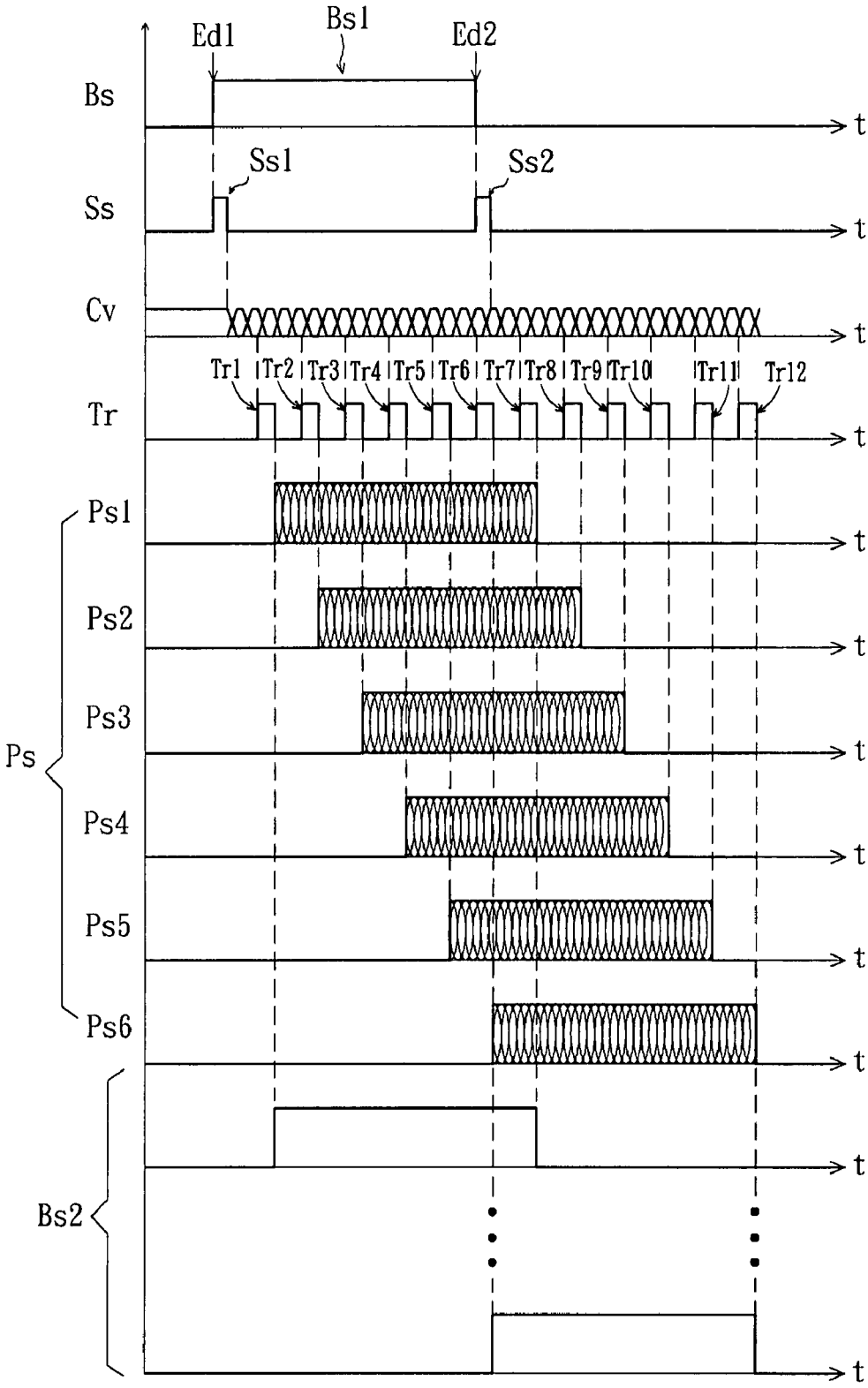
FIG. 5 is a timing diagram for the digital control circuit in FIG. 4.

Referring to FIGS. 4 and 5, the digital control circuit 4 includes a start signal generating unit 41, a counter unit 42, a memory unit 43, a comparator unit 44 and a driving unit 45. The digital control circuit 4 outputs a series of sequentially delayed driving signals Ps1 to Ps6 to oscillation step-up circuits 3. In this embodiment, the digital control circuit 4 drives six oscillation step-up circuits 3, for example. The delayed driving signals Ps' in FIGS. 2 and 3 may be generated by inverting the corresponding delayed driving signals Ps1 to Ps6.

In this embodiment, the start signal generating unit 41 generates the digital start signal Ss1 on receiving a start triggering edge Ed1 of a first digital burst signal Bs1 (see FIG. 5). In addition, the start signal generating unit 41 may further generate a digital end signal Ss2 on receiving an end triggering edge Ed2 of the first digital burst signal Bs1.

The counter unit 42 is electrically connected to the start signal generating unit 41, and starts to count on receiving the digital start signal Ss1 for generating counting values Cv. If the counter unit 42 is a 4-bit counter, it may count from 0000 to 1111. If the counter unit 42 is a 2-bit counter, it may count from 00 to 11. In this embodiment, the 2-bit counter is illustrated as an example. In addition, the counting unit 42 also starts to count after receiving the digital end signal Ss2. Herein, it is to be noted that the counting unit 42 may also be implemented by a timer.

The memory unit 43 stores at least one target counting value TCv. If the counter unit 42 is a 4-bit counter, the target counting value TCv may range from 0000 to 1111. If the counter unit 42 is a 2-bit counter, the target counting value TCv may range from 00 to 11. In this embodiment, the target counting value TCv indicates the length of time interval between sequent two of the delayed driving signals Ps'. Accordingly, the target counting value TCv indicates the turn-on time interval between two light loads 6.

The comparator unit 44 is electrically connected to the counter unit 42 and the memory unit 43. Whenever the counting value Cv matches the target counting value TCv, the comparator unit 44 generates a triggering signal Tr. In this embodiment, the counter unit 42 will be reset after the triggering signal Tr is generated. That is, after the counter unit 42 receives the triggering signal Tr outputted from the comparator unit 44, it starts to count again from 00. In this embodiment, six oscillation step-up circuits 3 are illustrated. Hence, there are six activating triggering signals Tr1 to Tr6 and six de-activating triggering signals Tr7 to Tr12.

The driving unit 45 is electrically connected to the comparator unit 44 and outputs the sequentially delayed driving signals Ps on receiving the triggering signals Tr. Herein, a time delay exists between subsequent two sequentially delayed driving signals. The driving unit 45 sequentially outputs six delayed driving signals PS1 to PS6 for respectively driving those six oscillation step-up circuits 3 so that the light loads 6 turn on and off alternately.

The driving unit 45 activates the delayed driving signal Ps1 on receiving the activating triggering signal Tr1. Similarly, on receiving the activating triggering signals Tr2 to Tr6, it activates delayed driving signals Ps2 to Ps6. Then, the driving unit 45 de-activates the delayed driving signal Ps1 on receiving the de-activating triggering signal Tr7. Similarly, on receiving the de-activating triggering signals Tr8 to Tr12 it de-activates the delayed driving signals Ps2 to Ps6.

In this embodiment, the digital control circuit 4 includes a digital control unit 46, a PWM generating unit 47, and a burst signal generating unit 48. The digital control unit 46 is electrically connected to the PWM generating unit 47, the burst signal generating unit 48, and the memory unit 43. The burst signal generating unit 48 generates the first digital burst signal Bs1. The start signal generating unit 41 is electrically connected to the burst signal generating unit 48 and generates the digital start signal Ss1 on receiving the first digital burst signal Bs1. The first digital burst signal Bs1 indicates the turn-on and turn-off periods for the light loads. For example, the time period while the light loads 6 turn on are equal to the time period while the first digital burst signal Bs1 is enabled. The burst signal generating unit 48 is controlled by the digital control unit 46, and modifies the frequency or duty cycle of the first digital burst signal Bs1 if needed.

In addition, the digital control unit 46 receives feedback signals FB such as voltage or current feedback signals from the light loads 6. The digital control unit 46 can control the burst signal generating unit 48 based on the feedback signals FB, such that the burst signal generating unit 48 is controlled to modify the frequency or duty cycle of the first digital burst signal Bs1.

The PWM generating unit 47 generates a digital pulse width modulation signal $S_{PWM}$. The PWM generating unit 47 is controlled by the digital control unit 46, and modifies the frequency or duty cycle of the digital pulse width modulation signal $S_{PWM}$ if needed. For example, the digital control unit 46 can control the PWM generating unit 47 based on the feedback signals FB to modify the frequency or duty cycle of the digital pulse width modulation signal $S_{PWM}$.

In one embodiment, the feedback signal FB may be analog signals. The digital control unit includes an analog-to-digital converter (ADC) to convert the feedback signal FB from an analog signal to a digital signal. Then, the digital control unit processes the feedback signal FB or performs a digital control on the overall digital control circuit. It is obviously that a signal loop from the digital feedback signal FB to the delayed driving signals Ps is implemented in digital.

Figure 6:
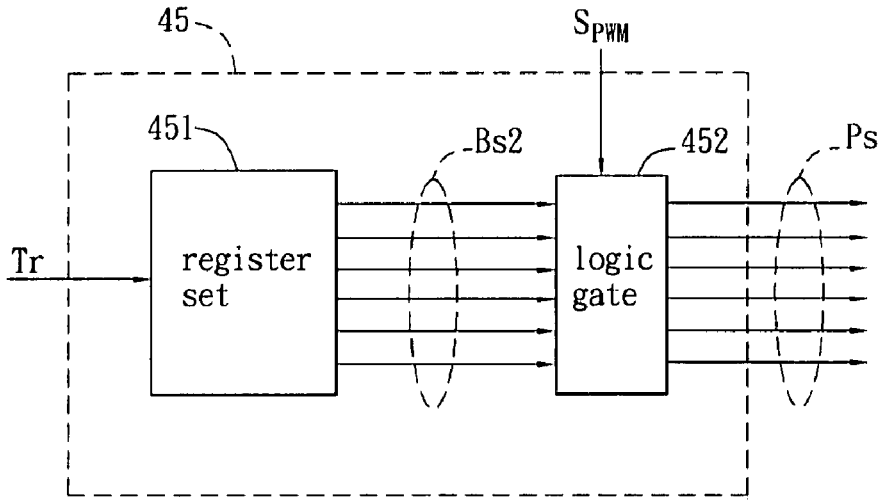
FIG. 6 is a block diagram showing a driving unit of the digital control circuit according to the preferred embodiment of the invention.

Referring again to FIG. 6, the driving unit 45 of the driving-control device 2 further includes a register set 451 and a logic gate array 452. The register set 451 is electrically connected to the logic gate array 452. The register set 451 sequentially outputs second digital burst signals Bs2 on receiving the triggering signals Tr, and the logic gate array 452 generates the sequentially delayed driving signals Ps on receiving the second digital burst signals Bs2 and a digital pulse width modulation (PWM) signal $S_{PWM}$. Each delayed driving signals Ps1 to Ps6 have different phase, and thus each of light loads 6 can be controlled respectively to light based on different phase, even on different duty cycle. The frequency of the second digital burst signal Bs2 is lower than that of the digital pulse width modulation signal $S_{PWM}$. For example, the frequency of the second digital burst signal Bs2 is 120 Hz, and the frequency of the digital pulse width modulation signal $S_{PWM}$ is 50 KHz.

Figure 7:
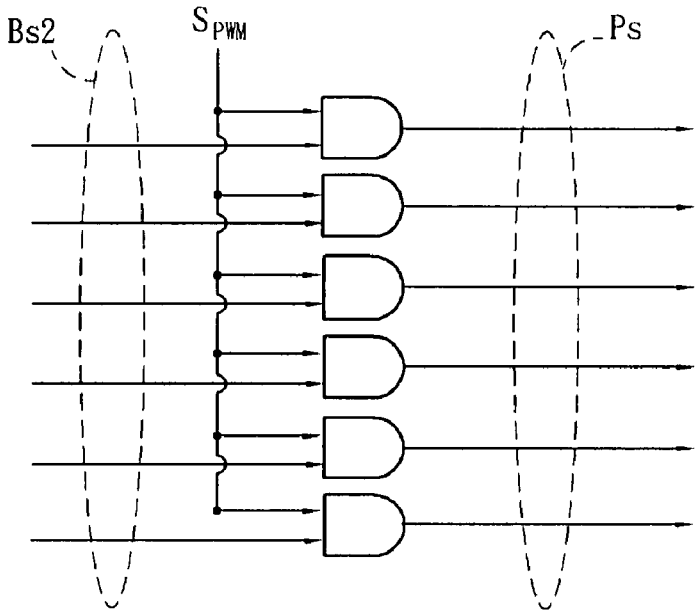
FIG. 7 is a schematic view showing a logic gate array of the driving unit in FIG. 6.

As shown in FIG. 7, the logic gate array 452 of this embodiment includes six AND gates $G_1$ to $G_6$, the second digital burst signals Bs2 outputted from the register set 451 are inputted to the AND gates $G_1$ to $G_6$, respectively, and the digital pulse width modulation signal $S_{PWM}$ is also inputted to the AND gates $G_1$ to $G_6$, respectively. The AND gates $G_1$ to $G_6$ may output the sequentially delayed driving signals Ps on receiving the second digital burst signal Bs2 and the digital pulse width modulation signal $S_{PWM}$.

Figure 8:
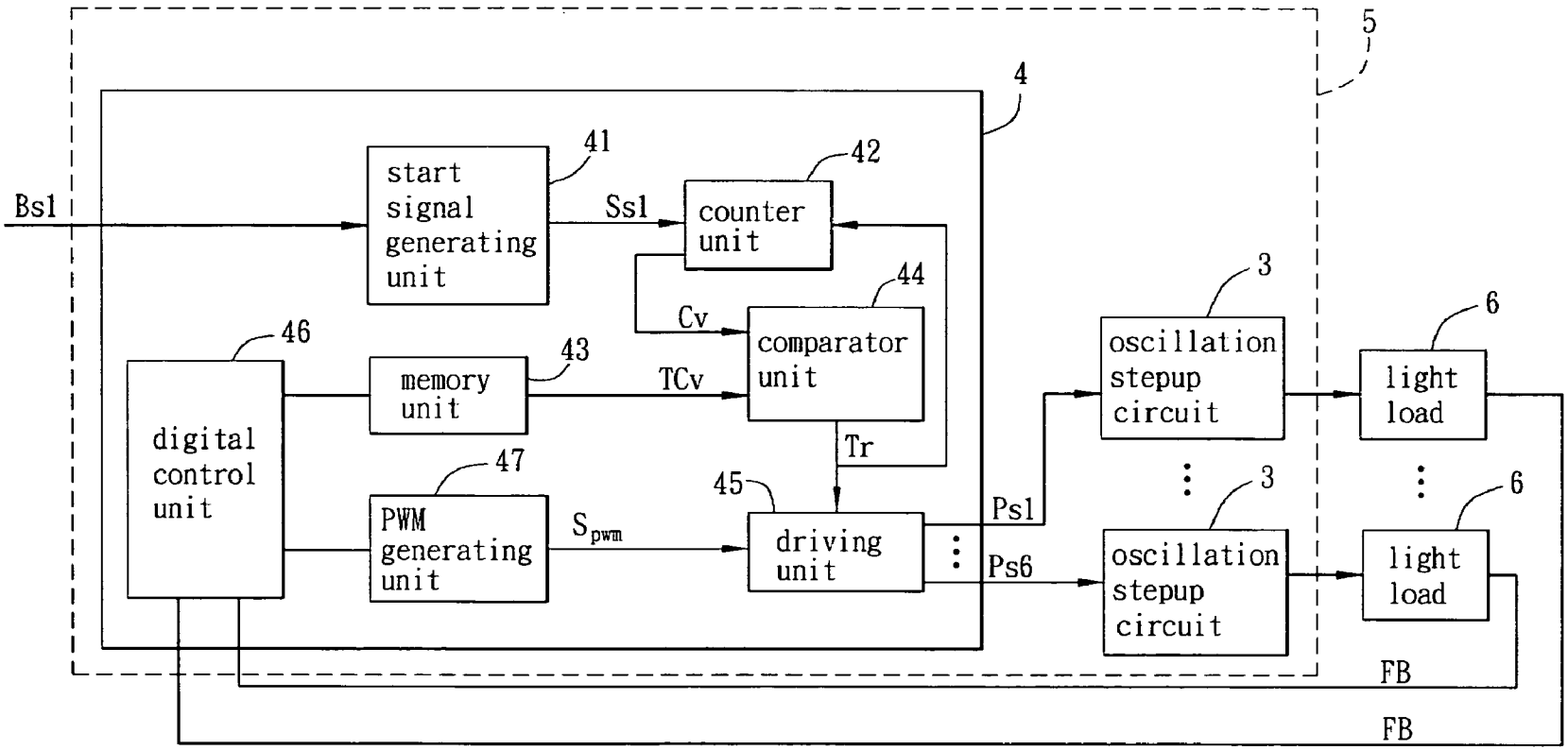
FIG. 8 is a block diagram showing a digital controlled multi-light driving apparatus according to another preferred embodiment of this invention.

Referring to FIG. 8, the burst signal generating unit is omitted in the digital control circuit 4. The first digital burst signal Bs1 may be a vertical synchronizing signal generated from a system controller of the display device and input to the start signal generating unit 41. The vertical synchronizing signal may be also provided to the display panel such as an LCD panel or an LED panel for refreshing the frame. The behavior of the first digital burst signal Bs1 is similar to that disclosed herein above with referring to FIG. 5. Thus, the detailed descriptions will be omitted.

Figure 9:
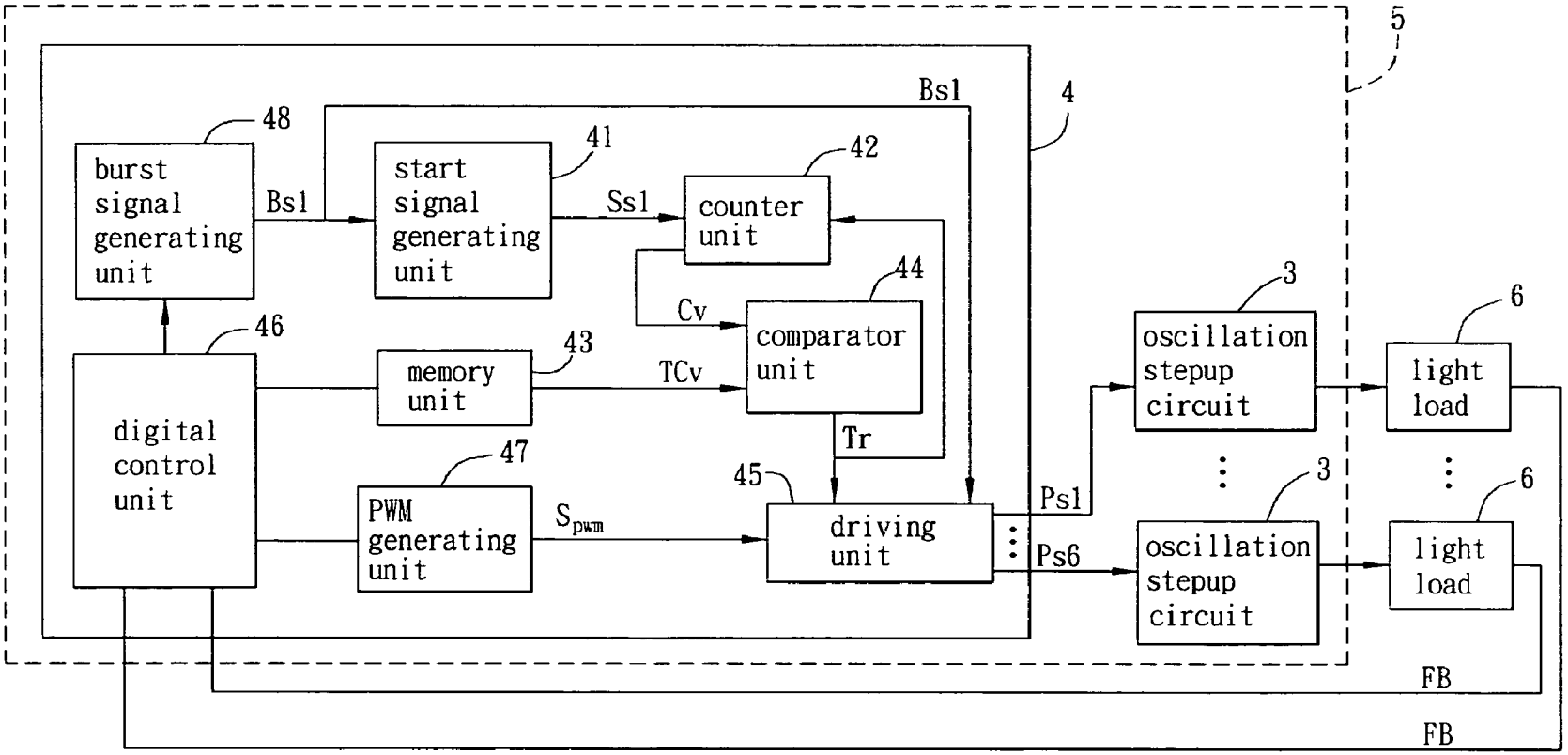
FIG. 9 is a block diagram showing another digital controlled multi-light driving apparatus according to another preferred embodiment of the invention.
Figure 10:
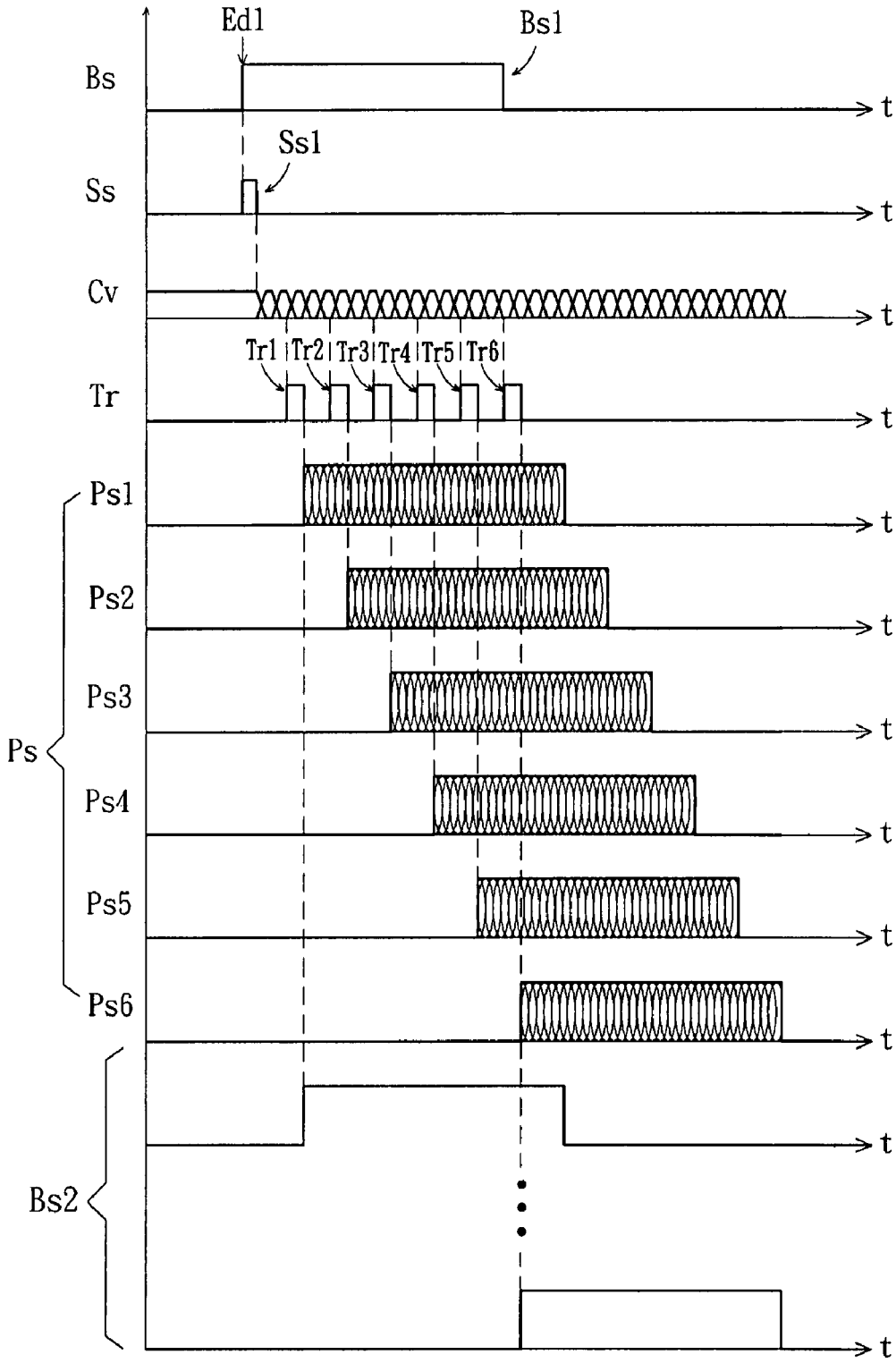
FIG. 10 is a timing diagram for the digital control circuit in FIG. 9.

As shown in FIGS. 9 and 10, a driving-control device according to another preferred embodiment of the invention includes the start signal generating unit 41, the counter unit 42, the memory unit 43, the comparator unit 44 and the driving unit 45. The driving unit 45 receives the first digital burst signal Bs1, and only the triggering signals Tr1 to Tr6 are outputted from the comparator unit 44 as shown in FIG. 9. After sequentially receiving the start triggering signals Tr1 to Tr6 and the first digital burst signal Bs1, the driving unit 45 sequentially outputs the second digital burst signals Bs2. The second digital burst signals Bs2 are just delayed versions of the first digital burst signals Bs1.

Figure 11:
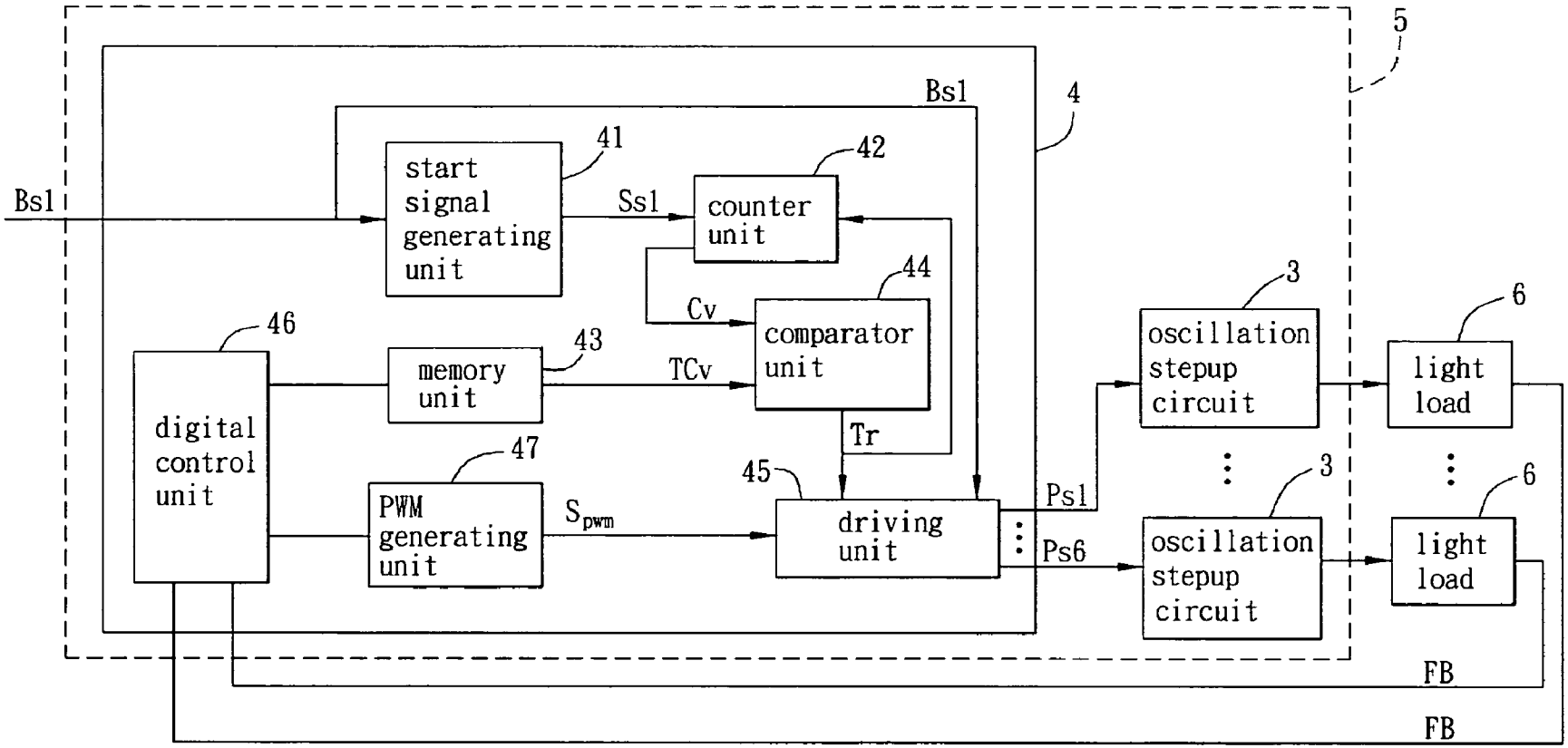
FIG. 11 is a block diagram showing another digital controlled multi-light driving apparatus according to another preferred embodiment of the invention.

Referring to FIG. 11, the burst signal generating unit is omitted in the digital control circuit 4. The first digital burst signal Bs1 may be a vertical synchronizing signal generated from a system controller of the display device and input to the start signal generating unit 41. The vertical synchronizing signal may be also provided to the display panel such as an LCD panel or an LED panel for refreshing the frame. The behavior of the first digital burst signal Bs1 is similar to that disclosed herein above with referring to FIG. 9. Thus, the detailed descriptions will be omitted.

Figure 12:
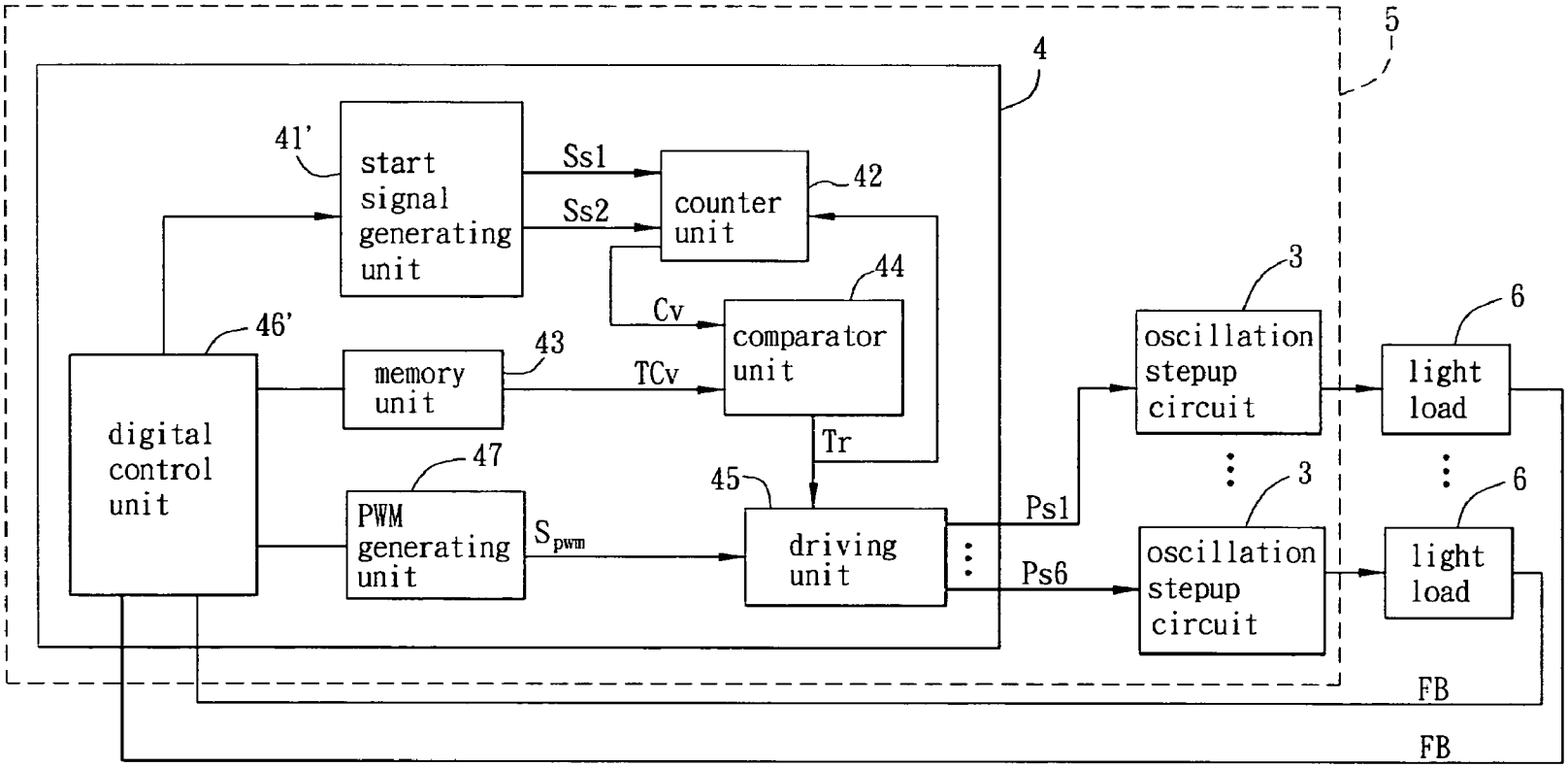
FIG. 12 is a block diagram showing another digital controlled multi-light driving apparatus according to another preferred embodiment of the invention.

Referring to FIG. 12, the digital control circuit 4 includes a digital control unit 46' and a start signal generating unit 41'. The start signal generating unit 41' is electrically connected to the digital control circuit 4, and generates the digital start signal Ss1 and the digital end signal Ss2 periodically. The frequency of the digital start signal Ss1 and the digital end signal Ss2 may be set by the digital control circuit 4. The digital start signal Ss1 and the digital end signal Ss2 are output to the counter unit 42. The behavior of the digital start signal Ss1 and the digital end signal Ss2 are similar to that disclosed herein above with referring to FIG. 5. Thus, the detailed descriptions will be omitted.

Figure 13:
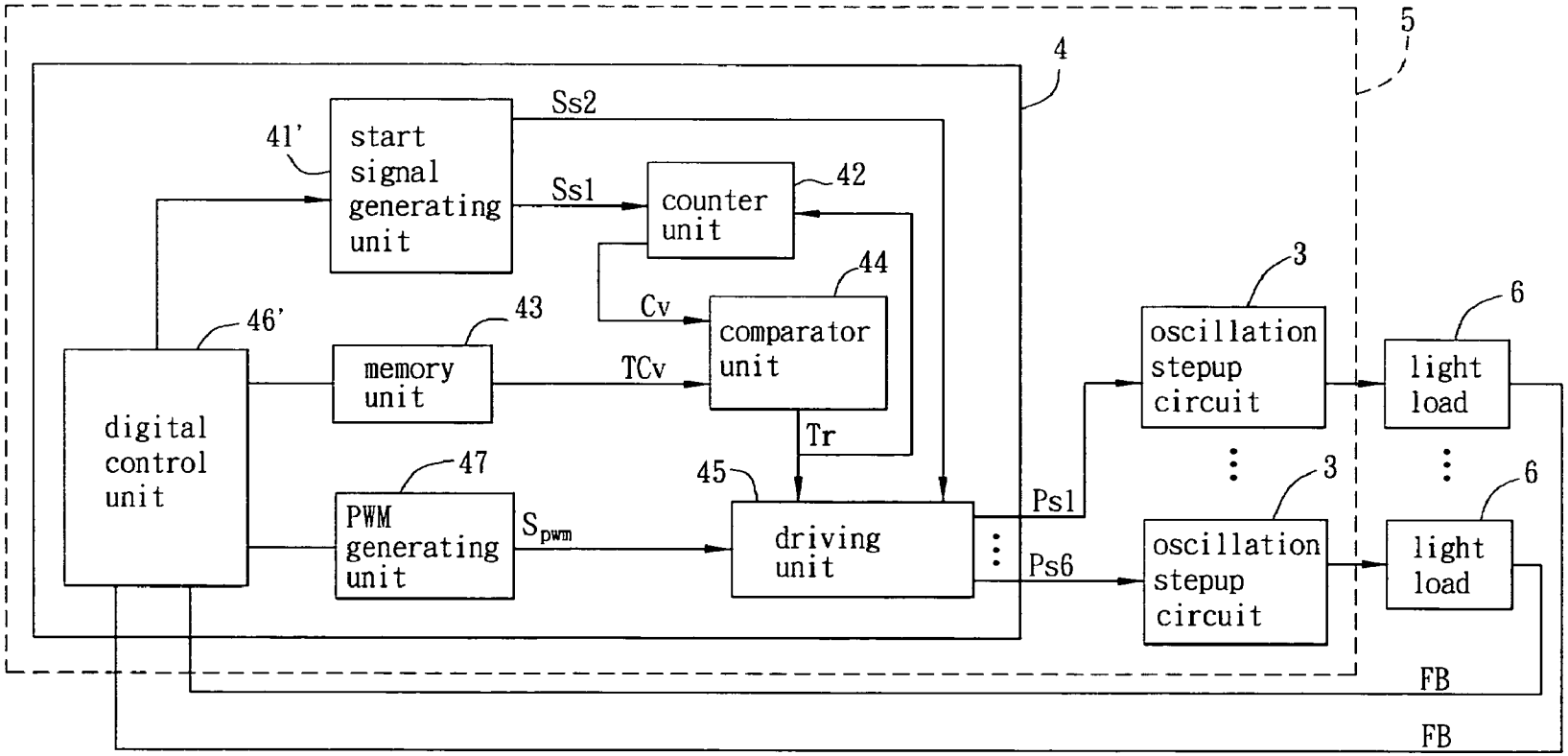
FIG. 13 is a block diagram showing another digital controlled multi-light driving apparatus according to another preferred embodiment of the invention.

Referring to FIG. 13, only the digital start signal Ss1 is output to the counter unit 42. The digital end signal Ss2 is output to the driving unit 45. The behavior of the digital start signal Ss1 is similar to that disclosed herein above with referring to FIG. 10. The digital end signal Ss2 is similar to the falling edge of the first burst signal Bs1 disclosed herein above with referring to FIG. 10. Thus, the detailed descriptions will be omitted.

Figure 14:
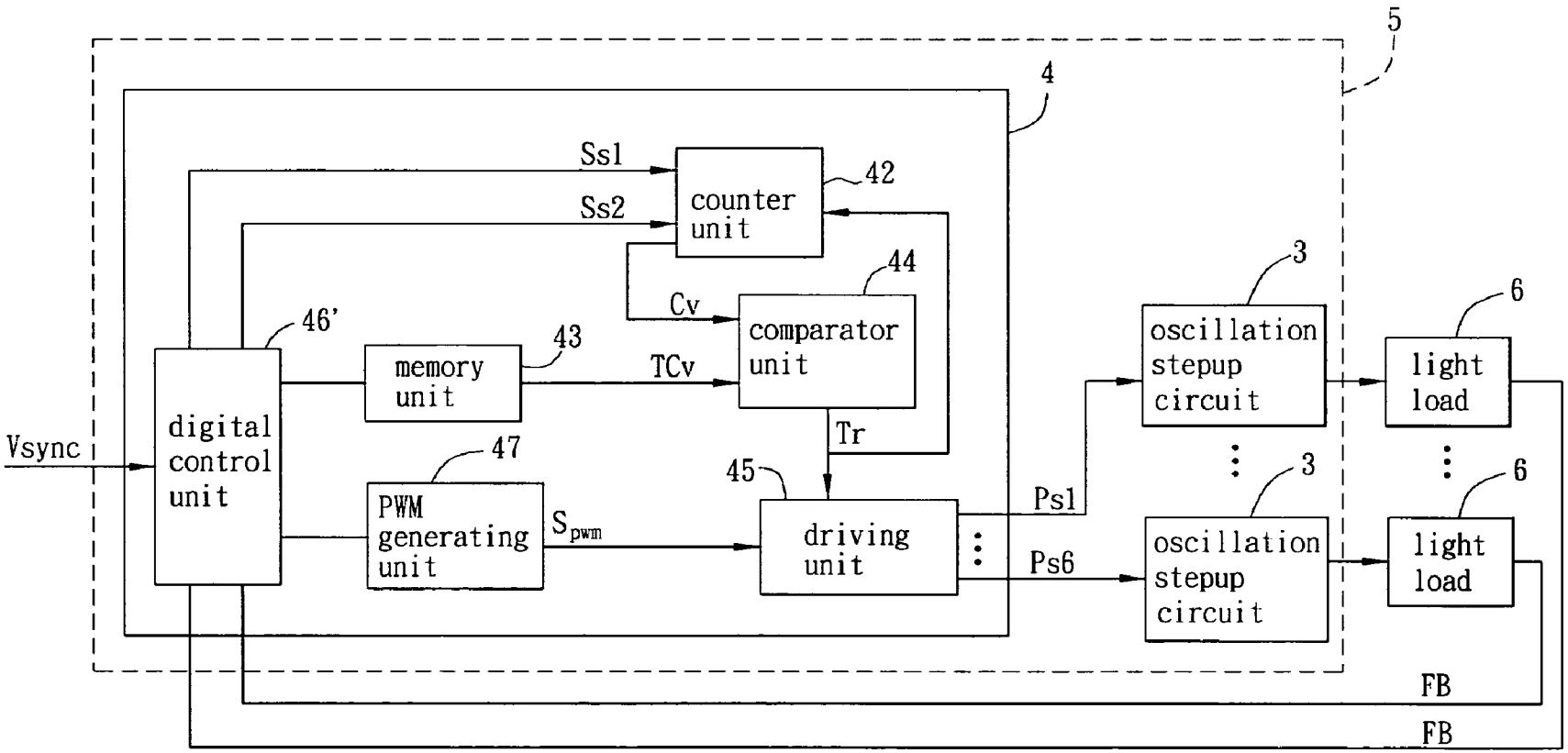
FIG. 14 is a block diagram showing another digital controlled multi-light driving apparatus according to another preferred embodiment of the invention.
Figure 15:
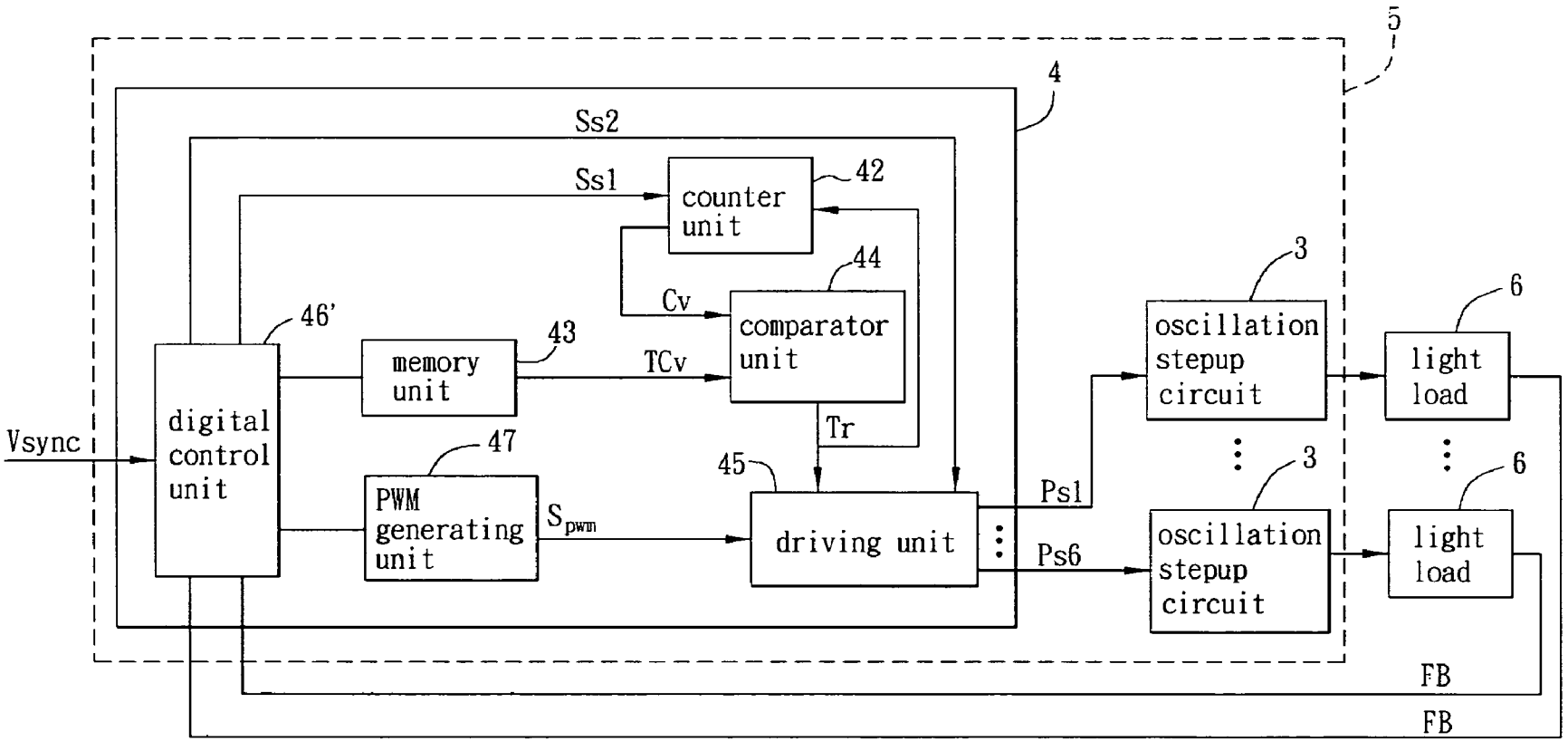
FIG. 15 is a block diagram showing another digital controlled multi-light driving apparatus according to another preferred embodiment of the invention.

Referring to FIGS. 14 and 15, the start signal generating unit is omitted in the digital control circuit 4. The digital control unit 46" may receive a vertical synchronizing signal Vsync generated from a system controller of the display device. The vertical synchronizing signal Vsync informs the digital control unit 46" to generate the digital start signal Ss1 and the digital end signal Ss2 periodically. The behavior of the vertical synchronizing signal Vsync is similar to the digital start signal Ss1 disclosed herein above with referring to FIG. 10. The digital end signal Ss2 is similar to the falling edge of the first burst signal Bs1 disclosed herein above with referring to FIG. 10. Thus, the detailed descriptions will be omitted.

Figure 16:
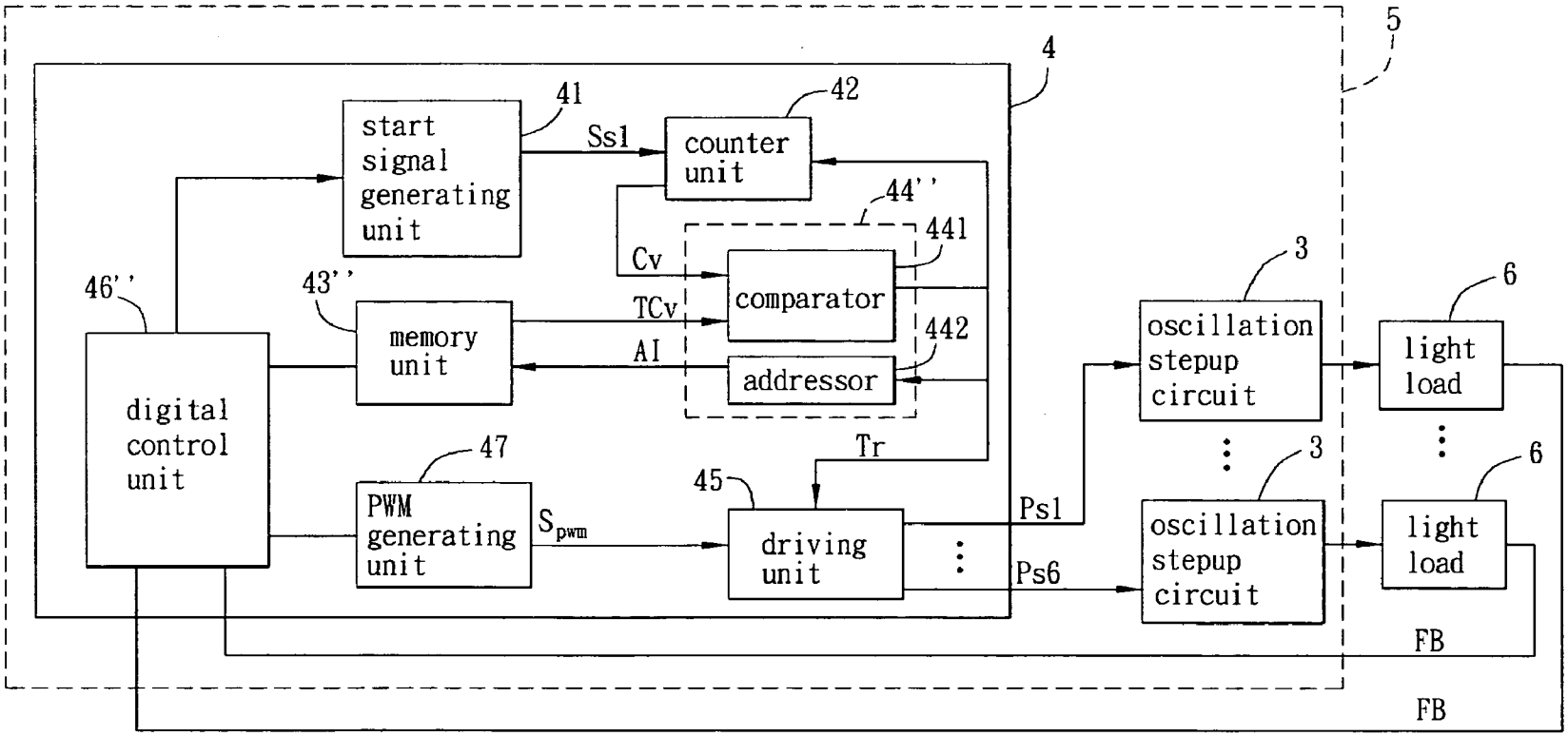
FIG. 16 is a block diagram view showing another digital controlled multi-light driving apparatus according to another preferred embodiment of the invention.

Referring to FIG. 16, the digital control circuit 4 includes a memory unit 43", a comparator unit 44" and a digital control unit 46". The memory unit 43" records a set of target counting values TCv. The comparator unit 44" includes a comparator 441 and an addressor 442. The digital control circuit 4 sends a trigger signal to trigger the counter starting to count. The trigger signal may be just a pulse, and it is not repeatedly send to the counter.

The digital control circuit 4 can set the target counting values stored in the memory. The addressor 422 generates an address instruction AI to select one of the target counting values TCv as the input of the comparator 441. Each target counting values TCv is selected in turn according to the address instruction AI. When the addressor 422 is triggered by the start triggering signals Tr, the addressor 422 modify the address instruction AI to select the next target counting value TCv. T hen the next target counting value TCv is selected to be the input of the comparator 441. If the final target counting value TCv is being selected, the next selected one is the first target counting value TCv.

Figure 17:
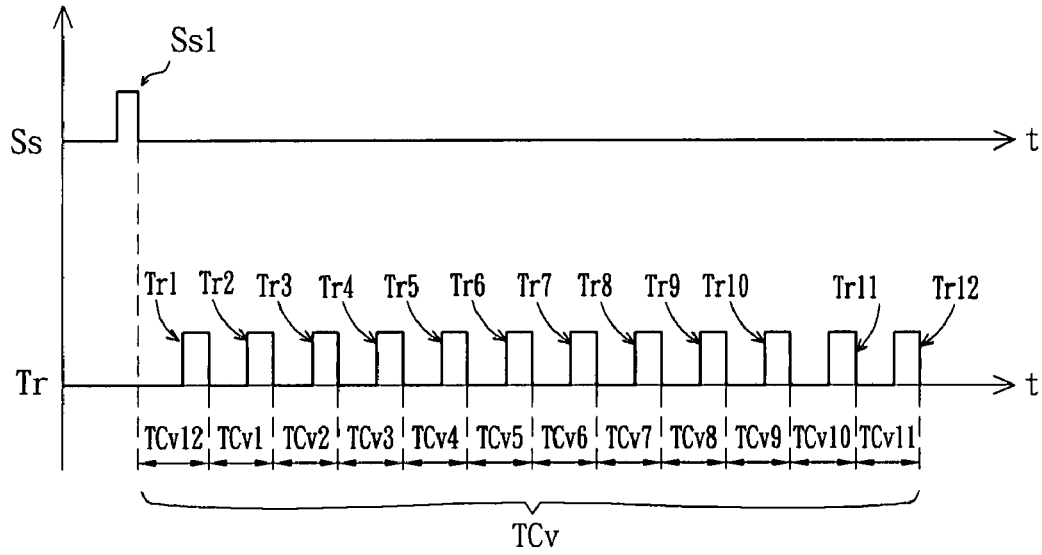
FIG. 17 is a schematic view showing the target counting values stored in the memory unit in FIG. 16.

Referring to FIGS. 16 and 17, at first, the address instruction AI selects the target counting value TCv1. Whenever the counting value Cv matches the target counting value TCv, the comparator unit 44" generates the triggering signal Tr. The triggering signal Tr triggers the addressor 422, and then the addressor 422 modifies the address instruction AI to select the next target counting value TCv2. The address instruction AI selects the target counting value TCv2 to be the input of the comparator 421. If the final target counting value TCv11 is being selected, the next selected one is the first target counting value TCv12. This procedure is repeated circularly.

In this embodiment, each target counting value TCv indicates the time interval between two sequential oscillation step-up circuits. Accordingly, each of the target counting values TCv1 to TCv5 may indicate the time interval between two sequential light loads 6, which are turned on. In addition, each of the target counting values TCv7 to TCv11 indicates the time interval between two sequential light loads 6, which are turned off.

The target counting value TCv6 indicates the time interval between the last light load that is turned on and the first light load that is turned off. The target counting value TCv12 indicates the time interval between the last light load that is turned off and the first light load that is turned on. The sum of the target counting values TCv1 to TCv5 may indicate the period of turn-on time of the light load 6 controlled by the delayed driving signal Ps1. In the same way, the sum of the target counting values TCvn to TCvn+4 may indicate the period of turn-on time of the light load 6 controlled by delayed driving signal the Psn. Each of the target counting values is set separately, and thus the light loads 6 can be controlled respectively based on different phases and duty cycles.

Figure 18:
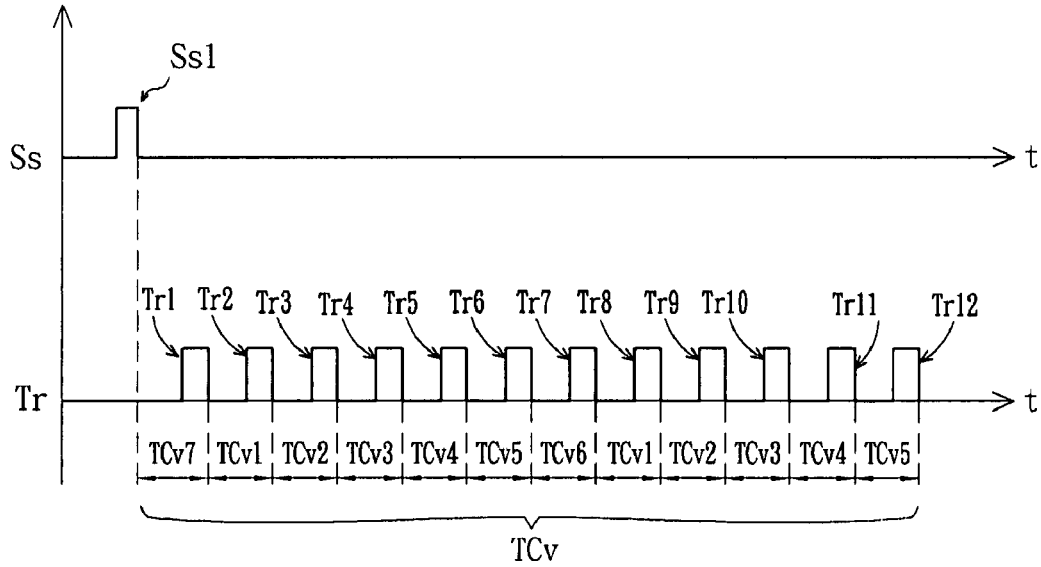
FIG. 18 is a schematic view showing the target counting values stored in the memory unit in FIG. 16.

Referring to FIG. 18, in this embodiment, the target counting values TCv1 to TCv5 indicate the time interval between two sequential light loads that are turned on and indicate the time interval between two sequential light loads that are turned off. The memory unit 43" does not record the target counting value TCv8 to TCv12.

Figure 19:
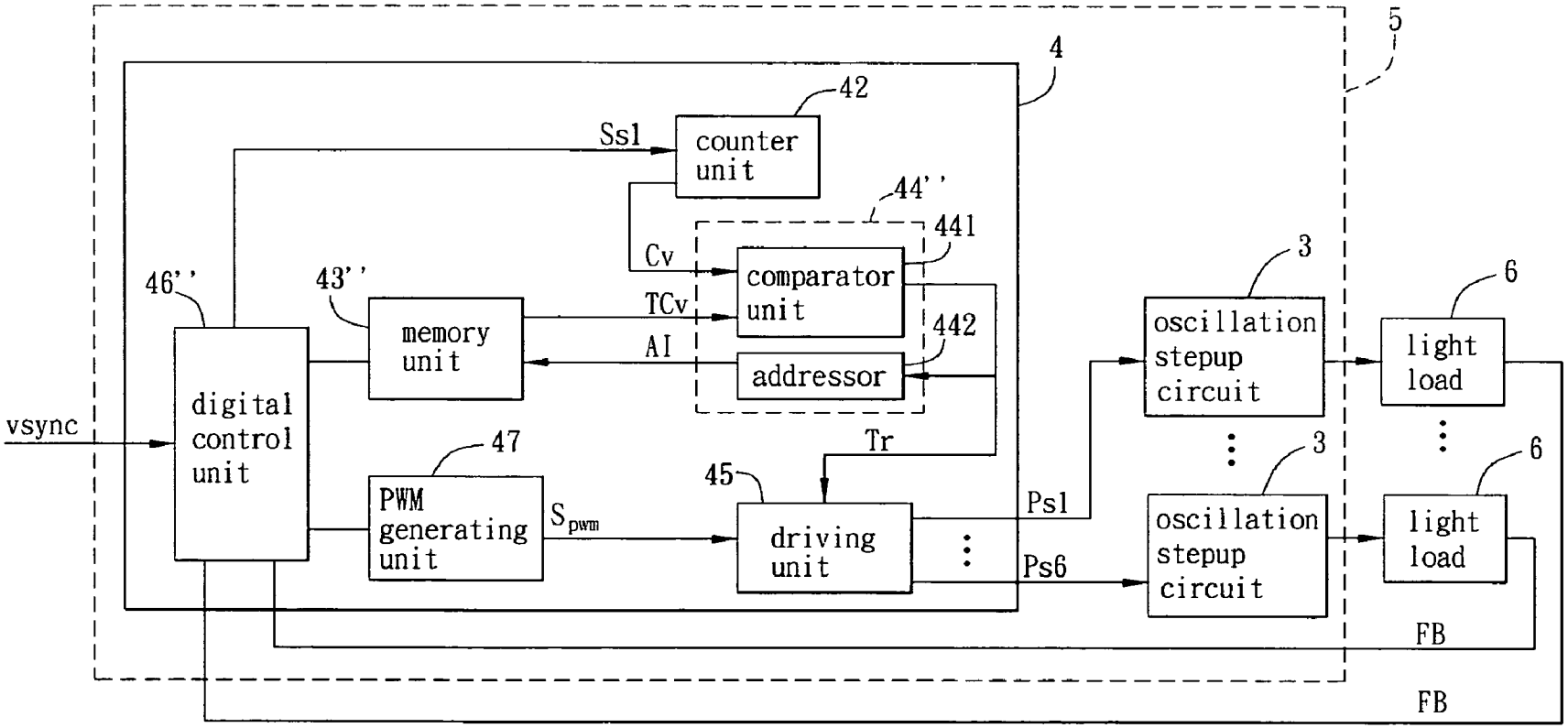
FIG. 19 is a block diagram view showing another digital controlled multi-light driving apparatus according to another preferred embodiment of the invention.

Referring to FIG. 19, the start signal generating unit is omitted in the digital control circuit 4. The digital control unit 46" may receive a vertical synchronizing signal Vsync generated from a system controller of the display device. The vertical synchronizing signal Vsync informs the digital control unit 46" to generate the digital start signal Ss1. The behavior of the vertical synchronizing signal Vsync is similar to the digital start signal Ss1 disclosed herein above with referring to FIG. 10.

Figure 20:
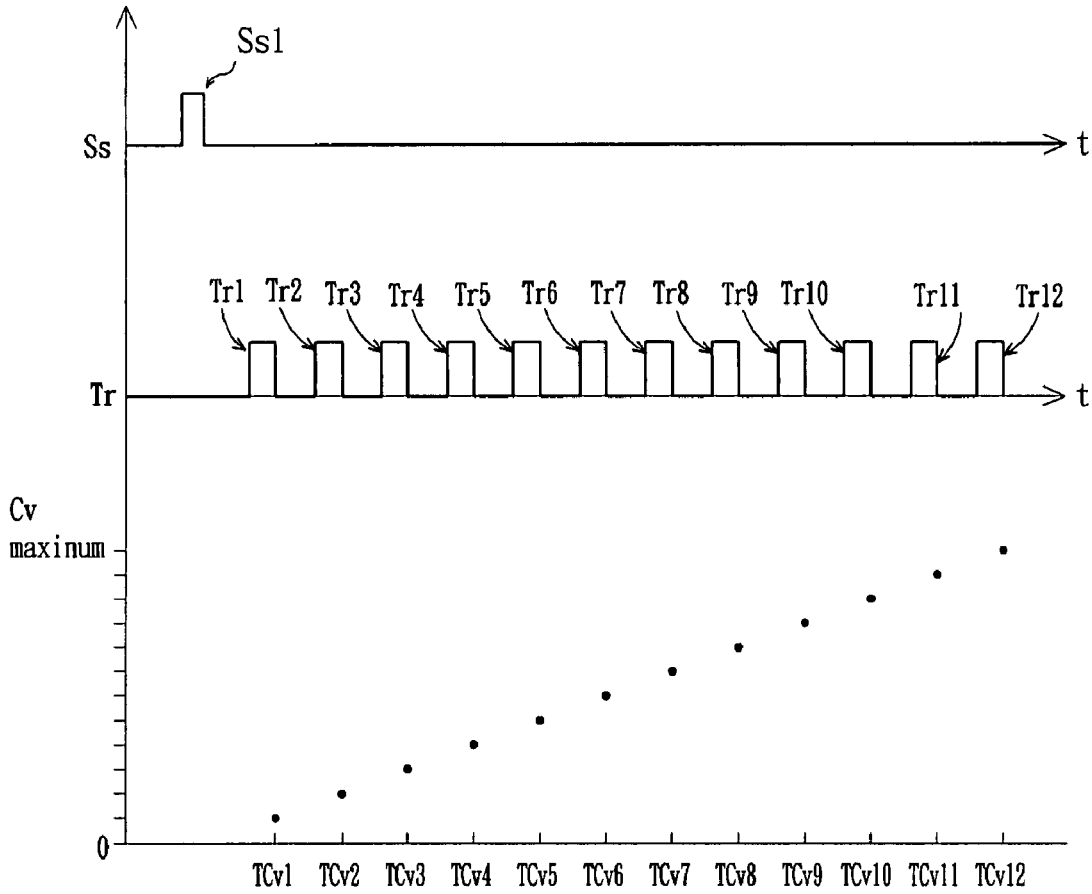
FIG. 20 is a schematic view showing the target counting values stored in the memory unit in FIG. 19.

In addition, referring to FIG. 20, each of the target counting values TCv1 to TCv6 may indicate the time that the corresponding light load should be turned on, and each of the target counting values TCv7 to TCv12 may indicate the time that the corresponding light load should be turned off. In this embodiment, the target counting values TCv1 to TCv12 are increased progressively. When the counting value Cv reaches its maximum, the counting value Cv becomes 0. It is unnecessary to apply an additional signal to reset the counter unit 42. The maximum of the counting value Cv corresponds to the cycle of the start triggering signals Tr, or the cycle of the vertical synchronizing signal.

In one embodiment, the comparator 441 and the addressor 442 may be implemented with hardware, firmware or software. The comparator 441 may be a program executed by a digital computing element, a control-calculator, or a processor. The addressor 442 may be implemented with a pointer recording the address information stored in the memory unit.

Figure 21:
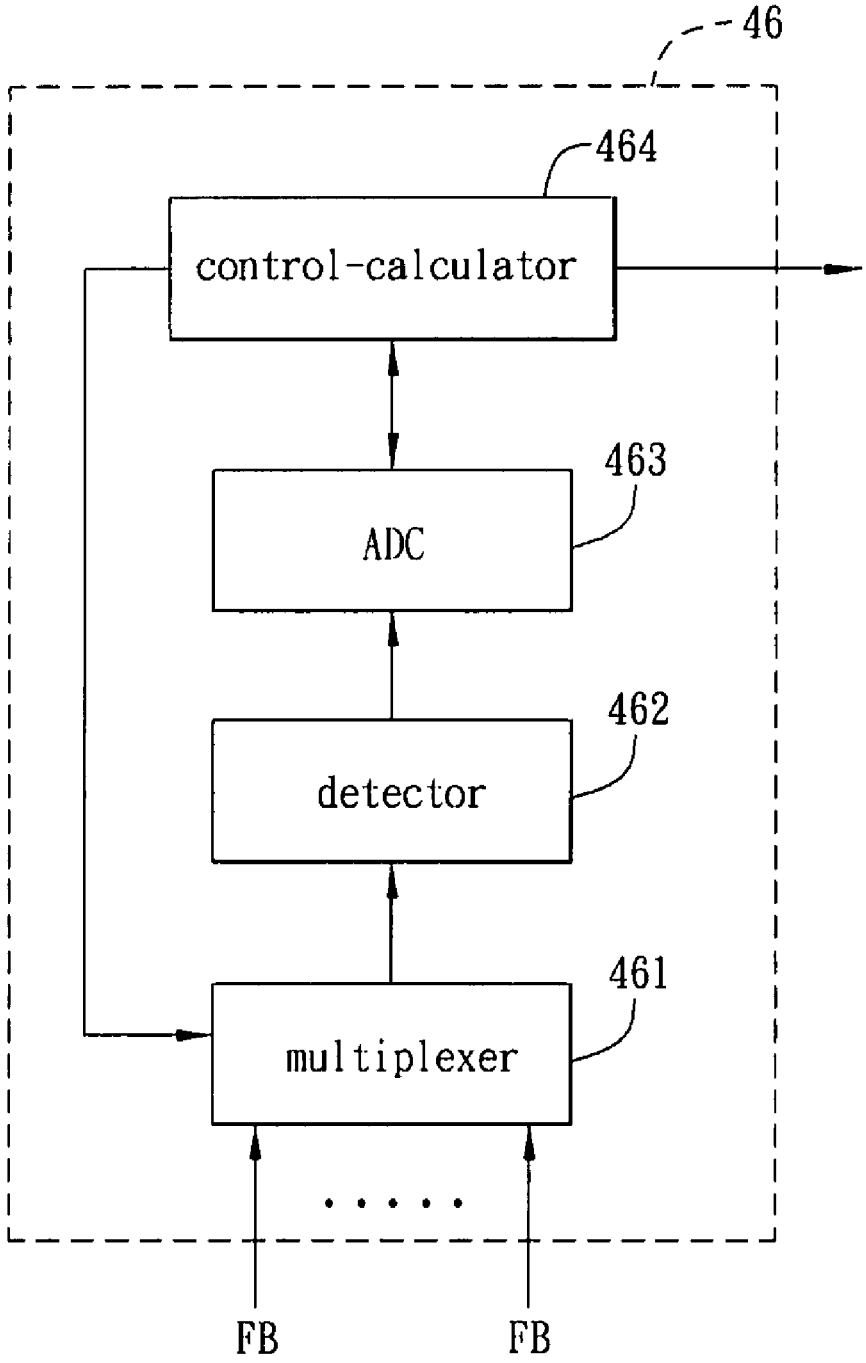
FIG. 21 is a block diagram showing a digital control unit of the digital control circuit of the invention.

Referring to FIG. 21, the digital control unit 46 includes a multiplexer 461, a detector 462, an ADC 463, and a control-calculator 464. The multiplexer 461 is electrically connecting to each of the light loads 6. The detector 462 detects the feedback signals FB from the light loads. The ADC 463 respectively converts the feedback signals FB into digital feedback signals. The control-calculator 464 controls the burst signal generating unit 48, the start signal generating unit 41, PWM generating unit 47 and/or the memory unit 43 according to the digital feedback signals described above in FIGS. 4-20. The control-calculator 464 further controls the multiplexer 461, so that the multiplexer 461 can pick one of the feedback signals to be detected. In addition, the control-calculator 464 may receive a vertical synchronizing signal to control the start signal generating unit or burst signal generating unit. The control-calculator 464 can execute programs to control the units or elements in the digital control circuit 4.

In practice, the digital control unit 46 can be a single-chip microprocessor. Alternatively, the digital control circuit 4 can be a single-chip microprocessor.

Figure 22:
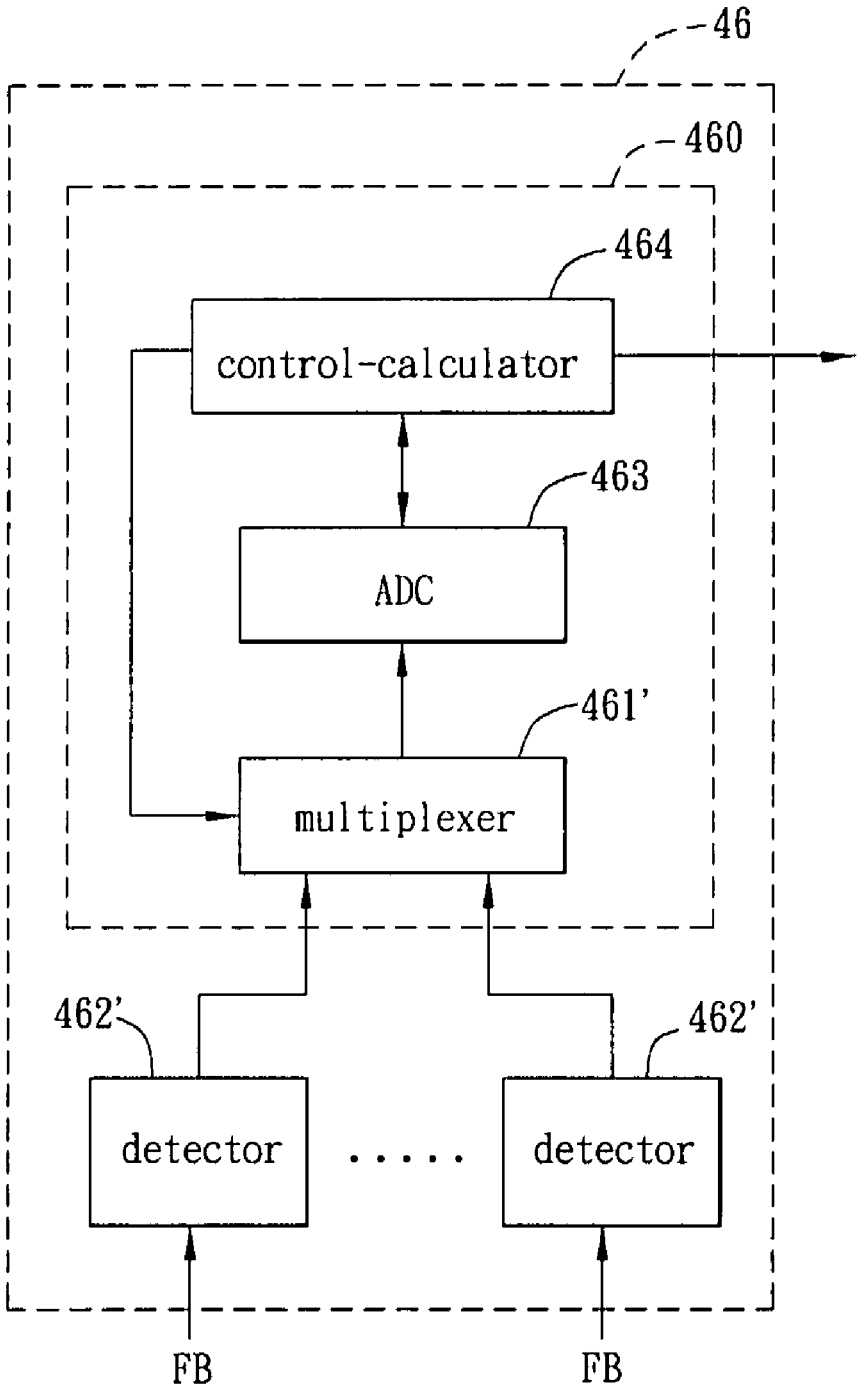
FIG. 22 is a block diagram showing a digital control unit of the digital control circuit of the invention.

Referring to FIG. 22, the digital control unit 46 includes a single-chip microprocessor 460 and a plurality of detectors 462'. The single-chip microprocessor 460 includes a multiplexer 461', an ADC 462', and a control-calculator 463'. The detectors 462' are electrically connected to the light loads 6, respectively, so as to detect the feedback signals from the light loads 6.

Figure 23:
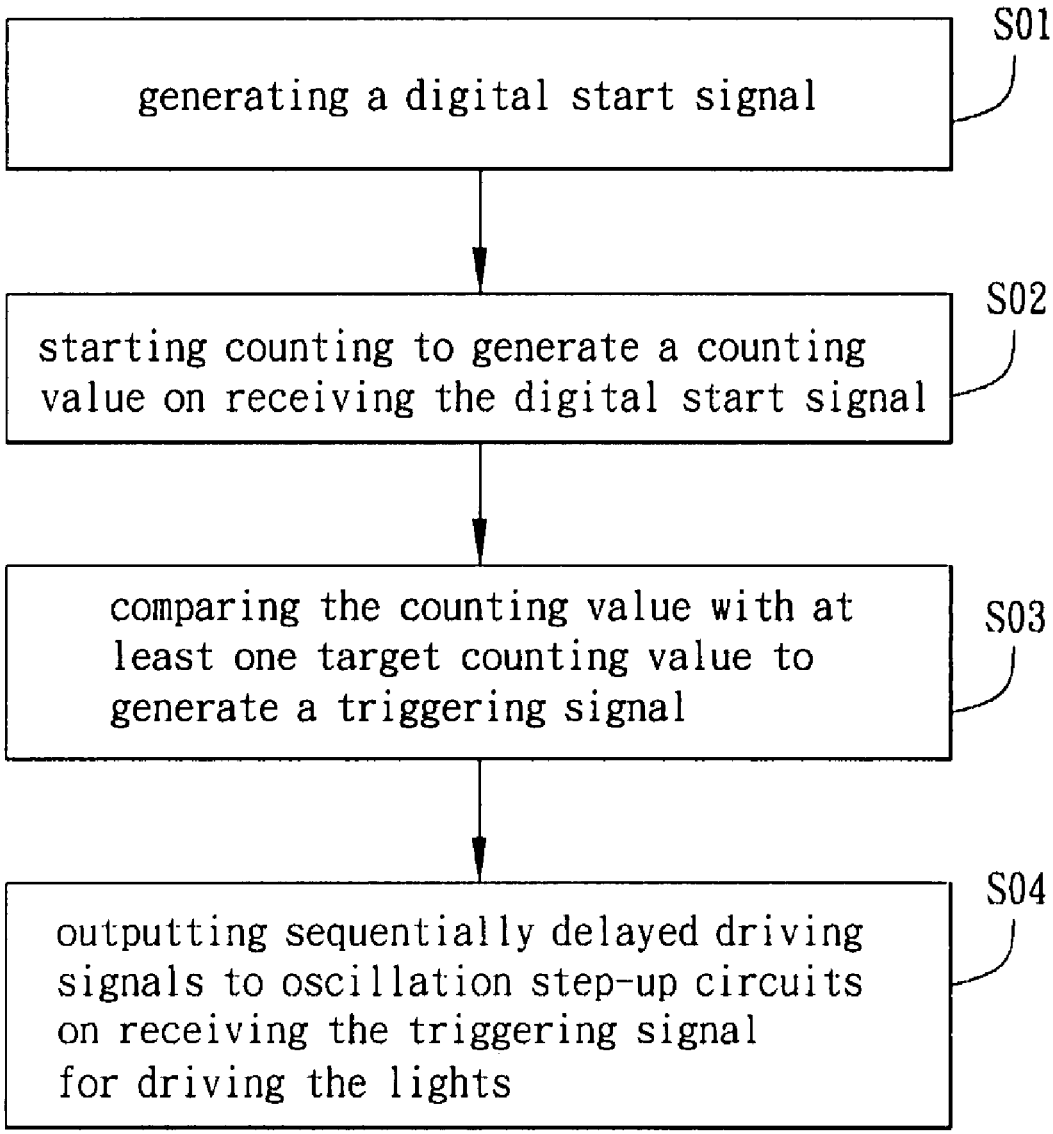
FIG. 23 is a flow chart showing a driving-control method according to the preferred embodiment of the invention.

Referring to FIG. 23, a driving-control method for driving and controlling a plurality of lights according to the preferred embodiment includes the following steps.

In step S01, a digital start signal is generated. Step S02 is to start counting to generate a counting value on receiving the digital start signal. In step S03, the counting value is compared with at least one target counting value TCv to generate a triggering signal. In step S04, sequentially delayed driving signals are outputted to a plurality of oscillation step-up circuits on receiving the triggering signal for driving the lights.

The detailed driving-control method and variations thereof have been described in the above-mentioned embodiments, so detailed descriptions thereof will be omitted.

In summary, the digital controlled multi-light driving apparatus and the driving-control method of the invention have the following advantages. The comparator unit is utilized to compare the counting values generated by the counter unit with the target counting value stored in the memory unit to generate the sequentially delayed driving signals. Thus, when the oscillation step-up circuits of the backlight module are driven by the sequentially delayed driving signals, the light driven by the oscillation step-up circuits can be sequentially lighted so that the lights alternately light on and off. In other words, the impulse-type display may be simulated using the simple digital circuit design in accordance with the driving-control device and the method of the backlight module of the invention, and the blurring phenomenon may be reduced.

Although the invention has been described with reference to specific embodiments, this description is not meant to be construed in a limiting sense. Various modifications of the disclosed embodiments, as well as alternative embodiments, will be apparent to persons skilled in the art. It is, therefore, comtemplated that the appended claims will cover all modifications that fall within the true scope of the invention.

What is claimed is:

1. A digital controlled multi-light driving apparatus for driving and controlling a plurality of lights, comprising:

a plurality of oscillation step-up circuits; and a digital control circuit having a counter unit, a memory unit, a comparator unit, and a driving unit, wherein the counter unit starts counting to generate a counting value whenever a digital start signal is generated, the memory unit stores at least one target counting value, the comparator unit is electrically connected to the counter unit and the memory unit to generate triggering signals whenever the counting value matches the target counting value, and the driving unit is electrically connected to the comparator unit to output sequentially delayed driving signals to the oscillation step-up circuits respectively on receiving the triggering signals.

2. The driving apparatus according to claim 1, wherein the digital control circuit further comprising:

a start signal generating unit for generating a digital start signal on receiving a first digital burst signal.

3. The driving apparatus according to claim 2, wherein the driving unit generates the sequentially delayed driving signals according to the triggering signals and the first digital burst signal.

4. The driving apparatus according to claim 1, wherein a time delay exists between sequential two of the sequentially delayed driving signals.

5. The driving apparatus according to claim 1, wherein the counter unit is electrically connected to the comparator unit and receives the triggering signals to reset and start counting again.

6. The driving apparatus according to claim 1, wherein the driving unit comprises:

a register set for outputting a second digital burst signals on receiving each of the triggering signals; and a logic gate array, electrically connected to the register set, for generating the sequentially delayed driving signals on receiving the second digital burst signals and a digital pulse width modulation signal.

7. The driving apparatus according to claim 6, wherein the logic gate array comprises a plurality of AND gates.

8. The driving apparatus according to claim 6, wherein the frequency of the second digital burst signal is lower than the frequency of the digital pulse width modulation signal.

9. The driving apparatus according to claim 1, wherein the driving unit sequentially transmits the sequentially delayed driving signals to the oscillation step-up circuits.

10. The driving apparatus according to claim 1, wherein each of the lights is a cold cathode fluorescent lamp (CCFL), a hot cathode fluorescent lamp (HCFL) or a light emitting diode (LED).

11. The driving apparatus according to claim 1, wherein the triggering signals comprise at least one activating triggering signal and at least one de-activating triggering signal.

12. The driving apparatus according to claim 11, wherein the driving unit activates one of the sequentially delayed driving signals with the activating triggering signal and de-activates the sequentially delayed driving signal with the de-activating triggering signal.

13. A driving-control method for driving and controlling a plurality of lights, the method comprising the steps of:

generating a digital start signal activating a counter unit to count so as to generate a counting value on receiving the digital start signal;

comparing the counting value with at least one target counting value to generate at least one triggering signal; and outputting sequentially delayed driving signals to a plurality of oscillation step-up circuits on receiving the triggering signal for driving the lights.

14. The driving-control method according to claim 13, wherein the digital start signal is generated on receiving a first digital burst signal.

15. The driving-control method according to claim 13, wherein the triggering signal is generated when the counter value matches the target counting value.

16. The driving-control method according to claim 13, further comprising the step of:

sequentially resetting the counter unit and starting the counter unit to count again so as to generate the counting value on receiving the triggering signals.

17. The driving-control method according to claim 13, further comprising the step of:

sequentially outputting a second digital burst signal on receiving the triggering signal.

18. The driving-control method according to claim 17, further comprising the step of:

generating the sequentially delayed driving signals on receiving the second digital burst signal and a digital pulse width modulation signal.

19. The driving-control method according to claim 13, wherein the triggering signals comprise an activating triggering signal for activating one of the sequentially delayed driving signals.

20. The driving-control method according to claim 13, wherein the triggering signals comprise a de-activating triggering signal for de-activating the one of the sequentially delayed driving signals.

* * * * *